US007845204B2

(12) United States Patent
Smyers et al.

(10) Patent No.: US 7,845,204 B2
(45) Date of Patent: Dec. 7, 2010

(54) CUP-SHAPED MEMBER FORMING APPARATUS

(75) Inventors: Charles V. Smyers, Hartville, OH (US); William J. Simmons, Canton, OH (US); Ronald S. Schlemmer, Canton, OH (US)

(73) Assignee: Standard Engineering Group, Inc., Akron, OH (US)

( * ) Notice: Subject to any disclaimer, the term of this patent is extended or adjusted under 35 U.S.C. 154(b) by 432 days.

(21) Appl. No.: 12/098,558

(22) Filed: Apr. 7, 2008

(65) Prior Publication Data

US 2009/0249856 A1 Oct. 8, 2009

(51) Int. Cl.
*B21D 28/02* (2006.01)
*B21D 28/14* (2006.01)

(52) U.S. Cl. ..... 72/349; 72/329; 72/336; 72/339; 72/348; 72/404; 413/69

(58) Field of Classification Search ..... 72/329, 72/336, 339, 342.3, 347, 348, 349, 364, 379.4, 72/404, 715; 413/56, 69
See application file for complete search history.

(56) References Cited

U.S. PATENT DOCUMENTS

| | | | | |
|---|---|---|---|---|
| 3,902,347 | A | 9/1975 | Ridgway et al. | |
| 4,416,140 | A | 11/1983 | Bulso, Jr. et al. | |
| 4,516,420 | A * | 5/1985 | Bulso et al. | 72/329 |
| 4,549,424 | A * | 10/1985 | Bulso et al. | 72/339 |
| 6,032,505 | A * | 3/2000 | Stodd | 72/348 |
| 7,000,445 | B2 * | 2/2006 | Hepner et al. | 72/349 |

* cited by examiner

*Primary Examiner*—David B Jones
(74) *Attorney, Agent, or Firm*—Buckingham, Doolittle & Burroughs, LLP

(57) ABSTRACT

A method and apparatus for forming cup-shaped members used in conjunction with a single-acting or a double-acting press having an outer punch assembly, an inner punch assembly and a base. A draw pad and a cutting edge are carried on the outer punch assembly, a draw horn is carried on the inner punch assembly and a blank and draw die is carried on the base. The draw pad and the draw horn oppose the blank and draw die such that the draw pad clampingly engages the blank and draw die in order to exert a clamping pressure on the pressure piston system having first and second pistons vertically stacked with respect to one another. The pressure piston system includes a damping member located within the pressure piston system for continuously increasing the clamping pressure during advancement of the outer punch assembly toward the base of the press.

17 Claims, 12 Drawing Sheets

CUP-SHAPED MEMBER FORMING APPARATUS

BACKGROUND OF THE INVENTION

1. Field of the Invention

The invention relates generally to the art of forming cup-shaped members such as metal containers from a blank of metal such as aluminum, steel, tin or other suitable material. More particularly, the invention relates to the formation of such metal containers in a single-acting press or a double-acting press which includes a vertically stacked arrangement of pistons having one or more damping members which reduce forces exerted on the pistons and also on the press by continuously increasing the pneumatic clamping force exerted on the metal blank when drawing the metal container.

2. Background Art

Cup-shaped members formed from metal have become popular for packaging food, such as beverages and moist pet foods, as well as other materials. These cups-shaped members are typically formed from a blank of metal using either a single-acting press or a double-acting press. More particularly, the cup-shaped member is formed by stamping a disk-shaped blank from a metal sheet. This disk-shaped blank is then drawn into the desired cup-like configuration. Following formation of the cup-shaped members, each of the members is filled with a predetermined quantity of food or other suitable product and are fitted with a metal lid or end closure. The lid is fixedly attached to the cup-shaped member using a separate process which crimps the lid onto the upper open portion of the cup-shaped member. The lid or end closure typically is formed with a pop-top or tab which provides the end user a relatively easy means for opening the cup-shaped member.

Cup-shaped members, like those described above, are typically formed in either a single-acting press or a double-acting press. Both single and double-acting presses for forming cup-shaped members are well known in the art. Although particular designs may vary, a typical single or double-acting press design cuts and draws the cup-shaped member in a single stroke of the press. More specifically, in these types of presses, the blank is cut from a metal sheet and is subsequently drawn into its final cup-shaped configuration in one single stroke of the press. Both single-acting presses and double-acting presses include multiple cut and forming dies which are capable of simultaneously forming a plurality of cup-shaped members, such as ten, twelve, or more cup-shaped members in a single stroke of the press. Because the present invention is capable of being used in conjunction with either a single-acting or a double-acting press, the general structure and operation of both presses is set forth below.

A single-acting press typically includes a single ram and a base. The single ram cuts and holds the blank from the sheet of material and also draws the blank into its final cup-shaped configuration. Of particular importance to the single-acting press is the pressure piston system which is carried on the single ram. The pressure piston system consists of a plurality of stacked pistons each of which is mounted within a respective cylinder which is in turn carried on the single ram of the press. As the single ram moves downwardly, it captures a portion of the metal sheet, cuts it into a blank, and clampingly engages the outer perimeter of the blank to the blank and draw die which is mounted on the base of the press. As the single ram continues to move downwardly, a draw horn draws the blank into a cup-shaped member as the pressure piston system continues to clampingly engage the outer edge of the blank.

A double-acting press typically includes an inner ram and an outer ram. The outer ram cuts and holds the blank from a sheet of material while the inner ram draws the blank into its final cup-shaped configuration. Of particular importance to the double-acting press, and more specifically the outer ram of the double-acting press, is the piston pressure system which is carried on the outer ram. This piston pressure system consists of a plurality of stacked pistons each of which is mounted within a respective cylinder which is in turn carried on the outer ram of the press. As the outer ram is moved downwardly, it captures a portion of the metal sheet, cuts it into a blank, and clampingly engages the outer perimeter of the blank to the blank and draw die which is mounted on the base of the press. The inner ram, which carries a draw horn, then moves downwardly through the annular space within the outer ram to draw the blank into a cup-shaped member as the outer ram clampingly engages the outer edge of the blank during the draw stage.

In this arrangement for both the single-acting and double-acting press, the pistons simultaneously engage one another resulting in a clamping pressure on the outer edge of the blank of about 6,000 pounds. In a typical single or double-acting press setup, there are three pistons, each of which are mounted within a respective one of three cylinders, each piston capable of exerting about 2,000 pounds of clamping pressure. Because the pistons are engaged simultaneously, an instantaneous application of the full 6,000 pound clamping load is imparted on the outer perimeter of the blank and the blank and draw die which is mounted on the base of the press. This instantaneous 6,000 pound clamping load can potentially cause excessive wear on the pistons as well as the blank and draw die mounted on the base of the press, which in turn can cause the pistons and the blank and draw die to fail prematurely. In addition, these large instantaneous forces can also potentially cause excessive noise and vibration in the press itself, which can in turn potentially lead to premature wear and ultimately possible failure of the press.

Therefore, a need exists in the art for a cup-shaped member forming apparatus which includes a pressure piston system design that reduces the effects of applying an instantaneous large clamping force on the blank material and the blank and draw die mounted on the base of the press in either a single or double-acting press, which can potentially cause excessive wear on the pistons and which potentially can lead to premature failure of the pistons and the press, while still reducing excessive noise and vibration in the press in order to decrease wear on the press.

These improvements are provided by the apparatus for forming cup-shaped members of the present invention, which includes a pressure piston system having an arrangement of stacked pistons which include one or more damping members that provide a continuous increase in clamping pressure exerted by the draw pad on the blank and draw die mounted on the base of the press in order to reduce the effects of applying an instantaneous clamping pressure on the pistons and to reduce wear on the pistons as well as reducing noise and vibration in the press.

SUMMARY OF THE INVENTION

The objectives of the present invention include providing an apparatus for forming cup-shaped members which is capable of being used in a single-acting press or a double-acting press and that reduces the effects of applying instantaneous large clamping forces on the pistons of the pressure piston system during the operation of the press.

Another objective of the present invention is to provide an apparatus for forming cup-shaped members capable of being used in a single-acting press or a double-acting press which reduces the effects of applying instantaneous large clamping forces to the draw pad mounted on the outer ram of a double-acting press or mounted on the single ram of a single-acting press and the blank and draw die mounted on the base of the press during operation of the press.

Yet another objective of the present invention is to provide an apparatus for forming cup-shaped members capable of being used in a single-acting press or a double-acting press which increases the wear life of the pistons in order to reduce the frequency of piston replacement and also to reduce operation and service costs.

Still yet another objective of the present invention is to provide an apparatus for forming cup-shaped members capable of being used in a single-acting press or a double-acting press which reduces noise and vibration in the press.

A further objective of the present invention is to provide an apparatus for forming cup-shaped members capable of being used in a single-acting press or a double-acting press which provides a continuous increase in clamping force on the blank material which is being drawn by the press.

Even yet another objective of the present invention is to provide a continuously increasing clamping force to the blank material to reduce marking or damage of the blank material or to the coating on the blank material that may occur when the clamping force is increased incrementally.

These objectives and advantages are obtained by the improved apparatus for forming cup-shaped members of the present invention, the general nature of which may be stated as including a cup-shaped member forming apparatus for use in a single-acting or a double-acting press having an outer ram, an inner ram and a base. A draw pad and a cutting edge are carried on the outer ram. A draw horn is carried on the inner ram. A blank and draw die is carried on the base. The blank and draw die generally opposes the draw pad and the draw horn. The cutting edge is configured to engage a sheet material disposed between the draw pad and the blank and draw die for cutting a disk from the sheet material. The draw pad is configured to engage the disk and the blank and draw die for exerting a clamping force on the disk and the blank and draw die during operation of the press. A pressure piston system is carried by the outer ram. The pressure piston system is operatively connected to a pneumatic air supply and includes at least a first piston and a second piston, the first and second pistons are vertically stacked with respect to one another. The first piston operatively mounted on a first cylinder and the second piston operatively mounted on a second cylinder. The first piston further including a damping member disposed between the first piston and the second piston. The first piston operatively engaged with the draw pad such that when said outer ram is advanced toward the base the clamping force of the draw pad on the disk and the bland and draw die is continuously increased.

These objectives and advantages are also obtained by the method for forming cup-shaped members of the present invention, the general nature of which may be stated as including a method of forming a cup-shaped member from a metal sheet in a single-acting or a double-acting press having an inner ram, an outer ram, and a base. Providing a draw pad and a cut edge carried by the outer ram. Providing a draw horn carried by the inner ram. Placing a sheet material between a blank and draw die mounted on the base of the press and the draw pad, the cut edge and the draw horn. Advancing the cut edge and the draw pad toward the sheet material and the blank and draw die by moving the outer ram toward the base. Blanking a disk from the metal sheet by advancing the cut edge. Providing a first and second piston. The first piston engaged with the second piston and the draw pad. The first and second pistons having a damping member disposed therebetween, the pistons operatively connected to a pneumatic air supply. Applying a continuously increasing clamping pressure on the metal sheet by advancing the outer ram toward the base. Drawing the cup-shaped member from the disk by advancing the draw horn toward the base.

BRIEF DESCRIPTION OF THE DRAWINGS

Preferred embodiments of the invention, illustrative of the best mode in which applicants have contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

The improved cup-shaped member forming apparatus of the present invention is capable of being utilized in conjunction with either a single-acting or a double-acting press. Because the structure and operation of both single-acting and double-acting presses are generally well known in the art, the entire single-acting and/or double-acting press will not be described in detail. However, relevant portions of a prior art cup-shaped member forming apparatus which is capable of being used in conjunction with either a single-acting or a double-acting press will be described below being used with a double-acting press.

Figure 1:
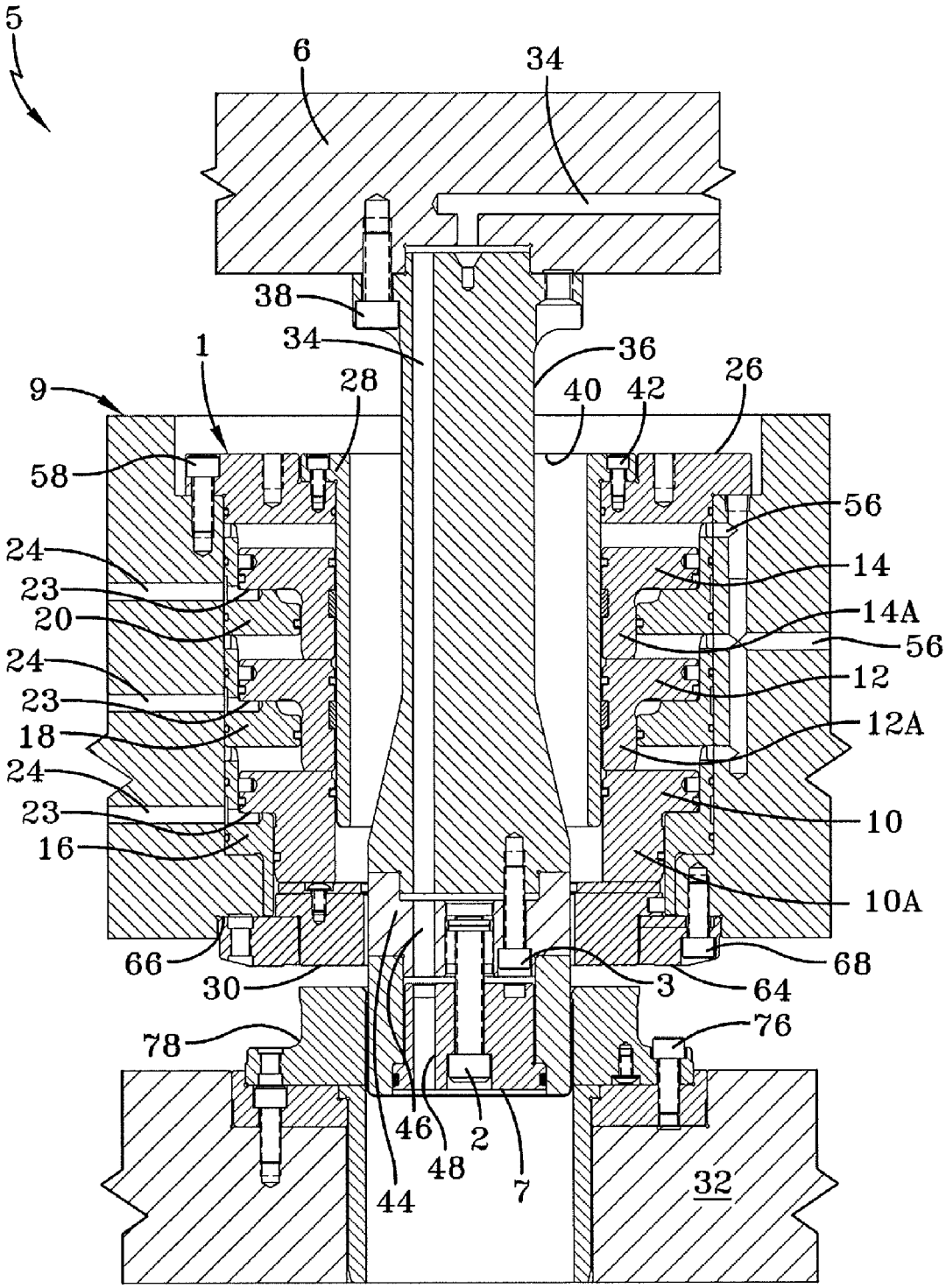
FIG-1 PRIOR ART
FIG. 1 is a sectional elevational view of a prior art cup-shaped member forming apparatus for a double-acting press, showing the outer punch assembly and the inner punch assembly of the press at the end of the draw.

With reference to FIG. 1, a prior art cup-shaped member forming apparatus for use in a double-acting press is shown generally at 5 and includes an outer punch assembly 9 and an inner punch assembly 6. A base component 32 is located generally below inner punch assembly 6 and outer punch assembly 9. Base component 32 is fixed with respect to inner punch assembly 6 and outer punch assembly 9 so that the inner punch assembly and the outer punch assembly reciprocate in relation to the base component. When utilized in conjunction with a double-acting press as shown in FIG. 1, outer punch assembly 9 is mounted on the outer ram of the press (not shown) and inner punch assembly 6 is mounted on the inner ram of the press (not shown) in a manner well known in the art. It should be understood that prior art cup-shaped member forming apparatus 5 could also be configured to be utilized with a single-acting press. In that configuration, outer punch assembly 9 and inner punch assembly 6 are combined into an upper punch plate that is mounted on the single ram of the single-acting press, in a manner well known in the art.

A riser 36 is fixedly attached to inner punch assembly 6 via a plurality of bolts 38 (only one shown), or other suitable fasteners. Riser 36 and inner punch assembly 6 are formed with an air passage 34 which is in fluid communication with a pneumatic air supply (not shown) such that compressed air is directed through the air passage during operation of the press. Riser 36 extends from the bottom of inner punch assembly 6 through an opening 40 in outer punch assembly 9 formed by a draw sleeve 28 which is in turn attached to an end cap 26 via a plurality of bolts 42 (only two shown), or other suitable fasteners. A spacer 44 is attached to the lower end of riser 36 via a plurality of bolts 3 (only one shown), or other suitable fasteners. Spacer 44 is formed with an air passage 46 which is in fluid communication with air passage 34 of riser 36. A draw horn 7 is, in turn, mounted on the bottom of spacer 44 via a bolt 2, or other suitable fastener. Draw horn 7 is formed with an air passage 48 which is in fluid communication with air passage 34 of riser 36 via air passage 46 of spacer 44. Air passages 48,34,46 allow compressed air from the pneumatic air supply (not shown) to pass through riser 36, through spacer 44, and through draw horn 7 in order to force the cup-shaped member from the draw horn at the end of the drawing process.

Outer punch assembly 9 includes a pressure piston system 1 which consists of a series of first, second and third pistons 10, 12, and 14, respectively, stacked on top of one another and each of which are in fluid communication with a source of high pressure air via conduits 56. Each of pistons 10,12,14 are carried within cylinders 16,18, and 20, respectively. Each cylinder 16,18,20 is formed with an opening 23 which are in fluid communication with an air passage 24 formed in the outer punch assembly 9. Air passages 24 are in fluid communication with atmosphere. End cap 26 seals the top of pressure piston system 1 and is attached via a plurality of bolts 58 (only one shown), or other suitable fasteners. Sleeve 28 forms a portion of pressure piston system 1. More particularly, sleeve 28 forms an inner portion of the chamber within which pistons 10,12,14 operate.

An annular draw pad 30 is operatively mounted in a stacked relationship beneath piston 10 in a manner well known in the art. Annular draw pad 30 operatively engages the lower leg 10A of piston 10. An annular cut edge 64 is mounted via a plurality of bolts 68 (only one shown) within a recess 66 in outer punch assembly 9 around draw pad 30 and slidably engages draw pad 30. Base component 32 carries an annular blank and draw die 78 which is secured to the base by a plurality of bolts 76 (only one shown), or other suitable fasteners.

As set forth above, draw pad 30 is engaged with lower leg 10A of piston 10. Piston 10 is in turn engaged with a lower leg 12A of piston 12, which in turn is engaged with a lower leg 14A of piston 14. Draw pad 30 clampingly engages blank and draw die 78 of base component 32 in order to clamp a blank of material (not shown) to the die so that the blank can be drawn by draw horn 7 of inner punch assembly 6 during operation of the press. Draw pad 30 and pistons 10,12,14 engage one another simultaneously in order to exert an instantaneous clamping force on the blank (not shown) and blank and draw die 78 mounted on base component 32 of about 6,000 pounds. More particularly, each piston 10,12,14 are capable of exerting about 2,000 pounds, respectively. Because pistons 10,12,14 engage one another simultaneously, they exert an instantaneous clamping force of about 6,000 pounds on the blank (not shown) and blank and draw die 78.

Figure 2:
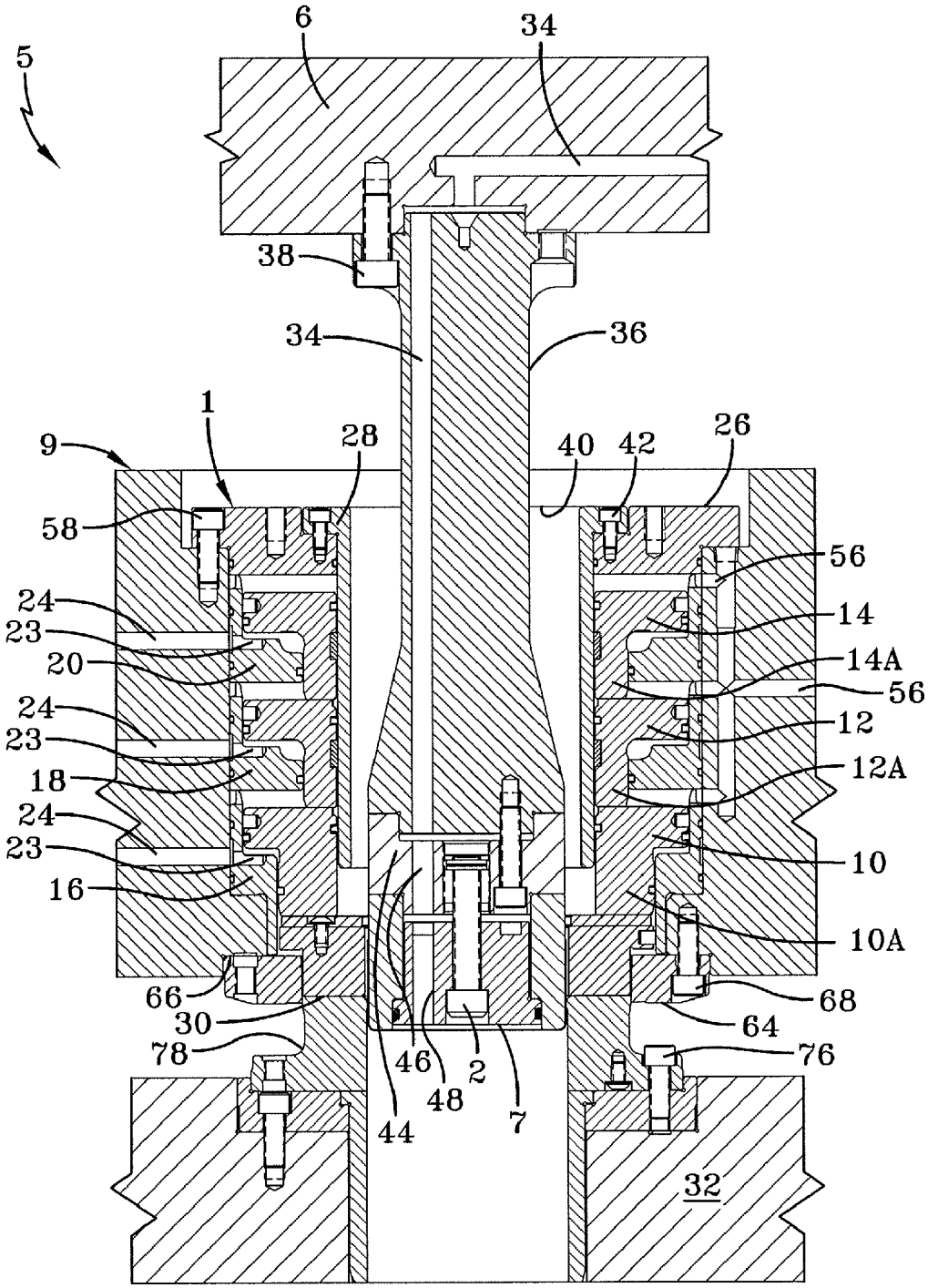
FIG-2 PRIOR ART
FIG. 2 is a view similar to FIG. 1, showing the outer punch assembly and the inner punch assembly of the press shortly after the beginning of the draw.

Having described the structure of prior art cup-shaped member forming apparatus 5, the operation of the cup-shaped member forming apparatus in a double-acting press will now be described. FIG. 2 shows cup-shaped member forming apparatus 5 following the blanking stage and shortly after beginning of the drawing stage of the operation. As outer punch assembly 9 moves downwardly toward base 32 annular cut edge 64 contacts the metal sheet of material (not shown) which is located between draw pad 30 and blank and draw die 78 of base component 32. As outer punch assembly 9 continues downwardly, cut edge 64 cuts a blank from the metal sheet. The blank which has been cut by cut edge 64 is then clampingly engaged between draw pad 30 of outer punch assembly 9 and blank and draw die 78 of base component 32. More particularly, draw pad 30 exerts an instantaneous clamping pressure of about 6,000 pounds on the outer edge of the blank and blank and draw die 78 below, capturing the outer portion of the blank between the draw pad of the outer punch assembly and the blank and draw die. In this manner, the blank is held in place by the instantaneous clamping pressure of draw pad 30 which also simultaneously engages pistons 10,12,14 in order to create the instantaneous clamping pressure. Inner punch assembly 6 then moves downwardly starting the draw stage of the operation. As inner punch assembly 6 moves downwardly, draw horn 7 mounted on the inner punch assembly engages the blank of material in order to draw the blank into a cup-shaped member as outer punch assembly 9 continues to clampingly engage the outer portion of the blank. As inner punch assembly 6 nears the end of the draw stage, the outer punch assembly begins to move upwardly, instantaneously releasing the clamping pressure from the out portion of the blank. As the clamping pressure is removed, the blank continues to be pushed downwardly by inner punch assembly 6 completing the formation of the cup-shaped member which then is forced off of draw horn 7 by the compressed air which passes through air passage 48. The cup-shaped member then drops onto conveyors (not shown) that are located in machined cavities in the underside of base component 32.

As set forth above, cup-shaped member forming apparatus 5 can potentially cause excessive wear on pistons 10,12,14 and on blank and draw die 78 as well as the press itself. The instantaneous excessive forces produced by prior art cup-shaped member forming apparatus 5 also can cause excessive noise and vibration in the press and can potentially cause the press to fail prematurely. The effects of these instantaneous large clamping forces might also cause premature failure of pistons 10,12,14 and also blank and draw die 78 mounted on base 32. These disadvantages of prior art cup-shaped member forming apparatus 5 capable of being used in a single-acting press and in a double-acting press have created a need in the art for a cup-shaped member forming apparatus that is capable of controlling clamping forces in order reduce wear on pistons 10,12,14 and also to reduce excessive vibration and noise in the press which can lead to premature failure of the press. The present invention satisfies these needs, as will now be described.

Figure 3:
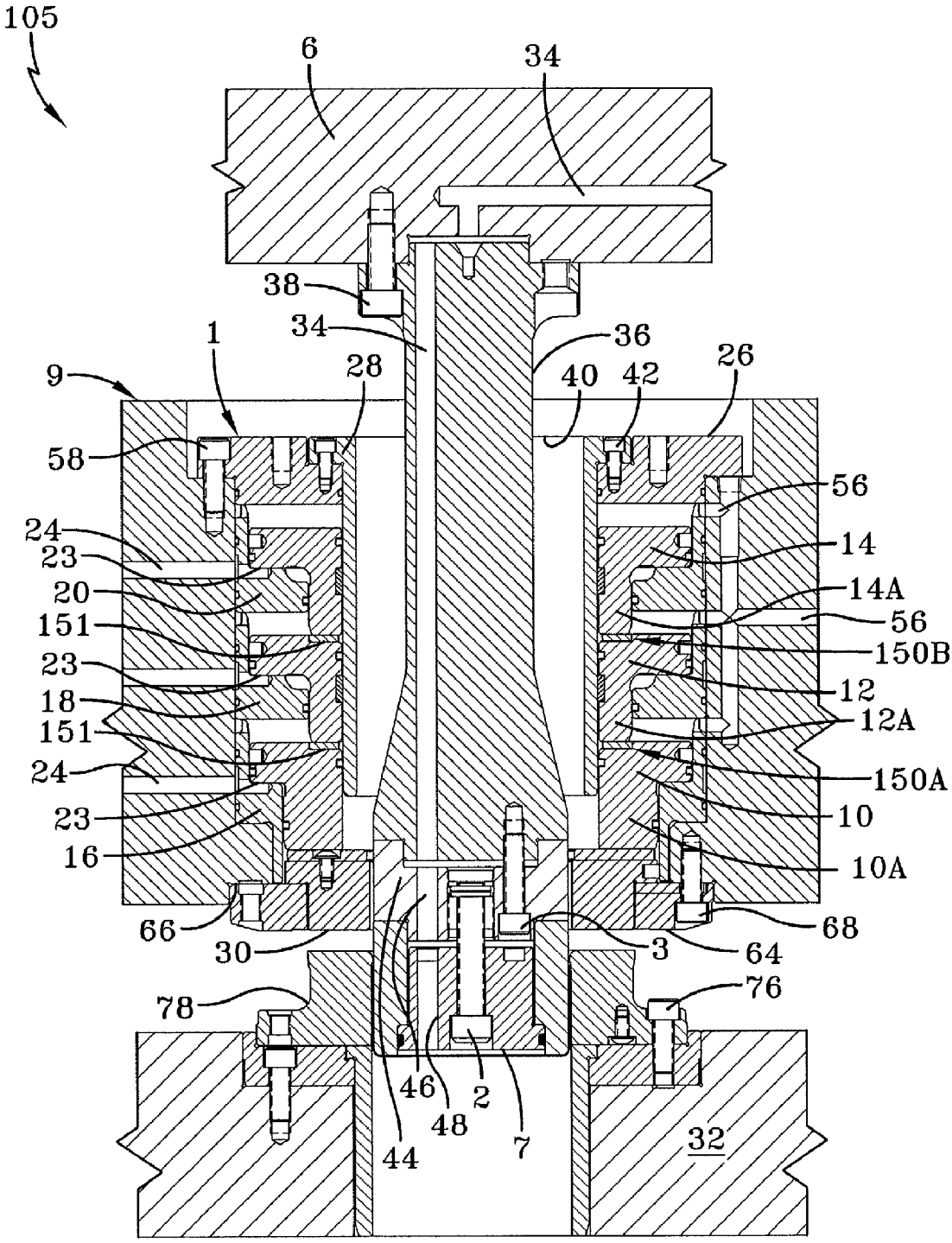
FIG. 3 is a sectional elevational view of a first preferred embodiment cup-shaped member forming apparatus of the present invention for a double-acting press, showing the damping member located between the pistons and showing the outer punch assembly and the inner punch assembly of the press at the end of the draw.
Figure 4:
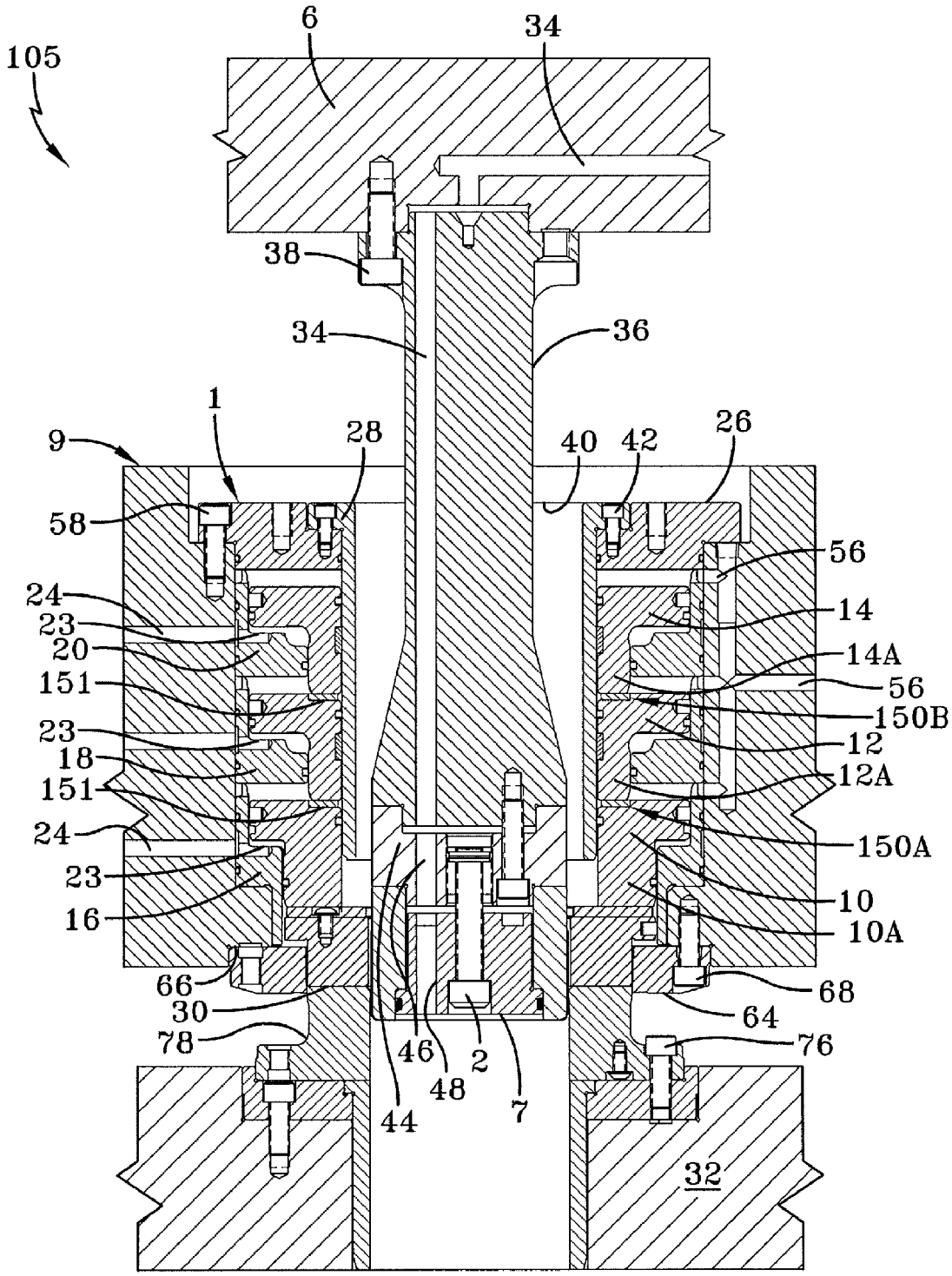
FIG. 4 is a view similar to FIG. 3, showing the outer punch assembly and the inner punch assembly of the press shortly after the beginning of the draw.

Turning now to FIGS. 3 and 4, a first preferred embodiment of the cup-shaped member forming apparatus of the present invention is shown generally at 105 and will be described in detail below in connection with a double-acting press. As first embodiment cup-shaped member forming apparatus 105 of the present invention is similar in many respects to prior art cup-shaped forming apparatus 5 described in detail above, only the differences between the two will be set forth below.

In accordance with one of the key features of the present invention, first preferred embodiment cup-shaped forming apparatus 105 of the present invention includes a pair of damping members 150A,B, each of which are mounted on a respective one of pistons 10 and 12. More particularly, damping members 150A,B are ring-like in shape having a cross-sectional height of about 0.250 inches, a cross-sectional width of about 0.500 inches, and an overall diameter of about 6.00 inches. Damping members 150A,B are formed from urethane, or other suitable material having a bulk elasticity or stiffness of about 75A to 95A Durometer. A corresponding recess 151 is formed in the top surface of each of pistons 10 and 12, the recess having generally the same diameter and cross-sectional height and width as damping members 150A, B. Damping member 150A is mounted in recess 151 of piston 10 and damping member 150B is mounted in recess 151 of piston 12. Damping members 150A,B are held in their respective recesses 151 of pistons 10 and 12 by an adhesive (not shown) such as loctite #380.

Having now described the structure of first preferred embodiment cup-shaped member forming apparatus 105 of the present invention, with additional reference to FIG. 4, its operation will now be described in detail below.

As outer punch assembly 9 moves downwardly toward base component 32 annular cut edge 64 contacts the metal sheet of material (not shown) which is located between draw pad 30 and blank and draw die 78 mounted on base component 32. Cut edge 64 cuts a blank from the metal sheet. The blank which has been cut by cut edge 64 is then clamped between draw pad 30 of outer punch assembly 9 and blank and draw die 78 of base component 32. More particularly, draw pad 30 exerts a continuously increasing clamping pressure onto the outer edge of the blank, capturing the outer edge of the blank between the draw pad of the outer punch assembly and blank and draw die 78 of base component 32. In this manner, the blank is held in place by the continuously increasing clamping pressure of draw pad 30 which simultaneously engages pistons 10,12,14 in order to create the continuously increasing clamping pressure. More specifically, the continuous increase in the clamping pressure is due to the existence of damping members 150A,B located between pistons 10,12, and 14. As damping members 150A,B are compressed between pistons 10,12,14, the clamping pressure exerted on blank and draw die 78 of base component 32 is continuously increased. Inner punch assembly 6 then begins to move downwardly beginning the draw stage of the press. As inner punch assembly 6 moves downwardly, draw horn 7 mounted on the inner ram engages the blank of material in order to draw the blank into a cup-shaped member as outer punch assembly 9 continues to clampingly engage the outer portion of the blank. As inner punch assembly 6 nears the end of the draw stage, the outer punch assembly begins to move upwardly, continuously decreasing clamping pressure from the outer portion of the blank. As the clamping pressure is continuously decreased, the blank continues to be pushed downwardly by inner punch assembly 6 forming cup-shaped member which then drops onto conveyors (not shown) that are located in machined cavities in the underside of base component 32.

Figure 5:
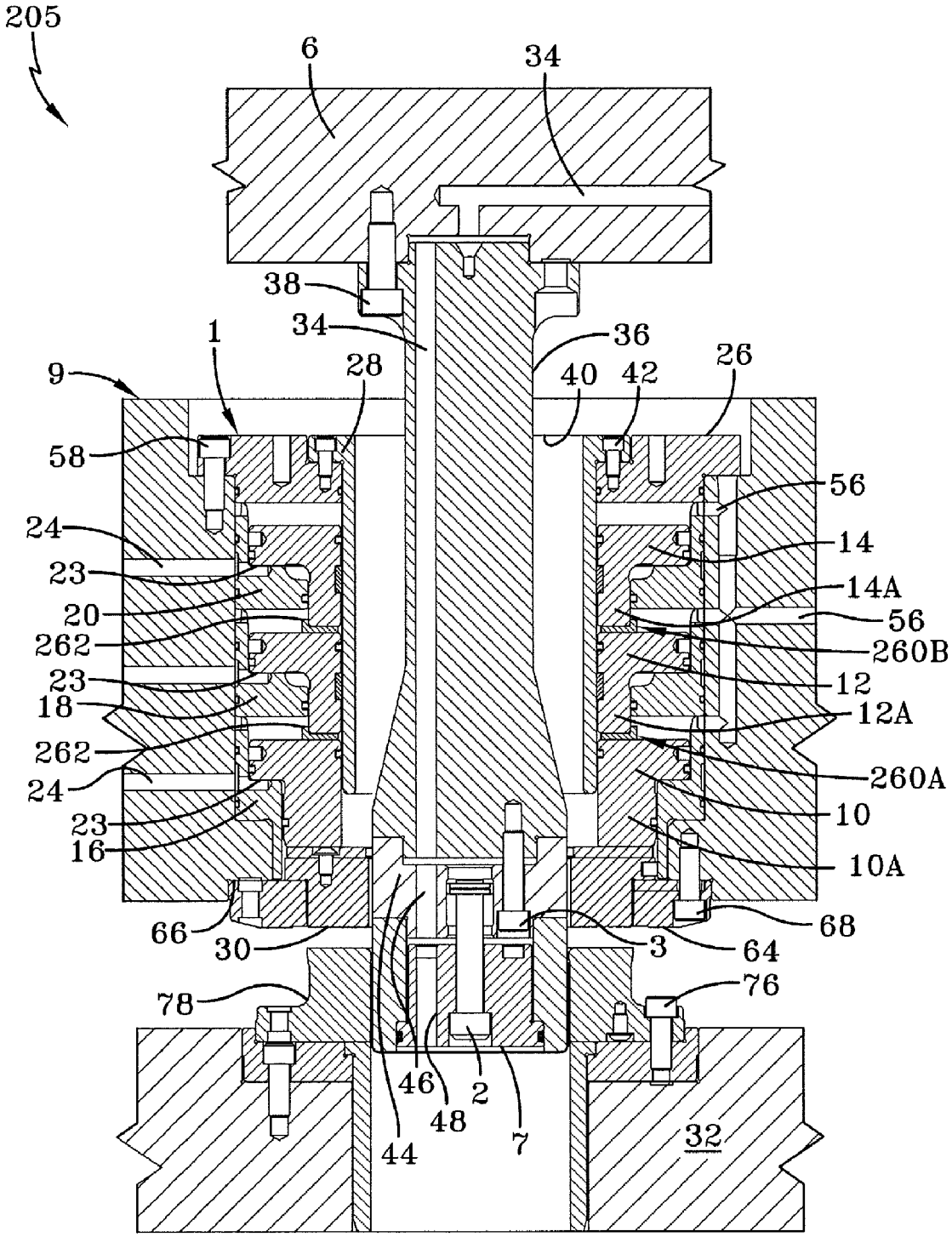
FIG. 5 is a sectional elevational view of a second preferred embodiment cup-shaped member forming apparatus of the present invention for a double-acting press, showing the damping member located between the pistons and showing the outer punch assembly and the inner punch assembly of the press at the end of the draw.
Figure 6:
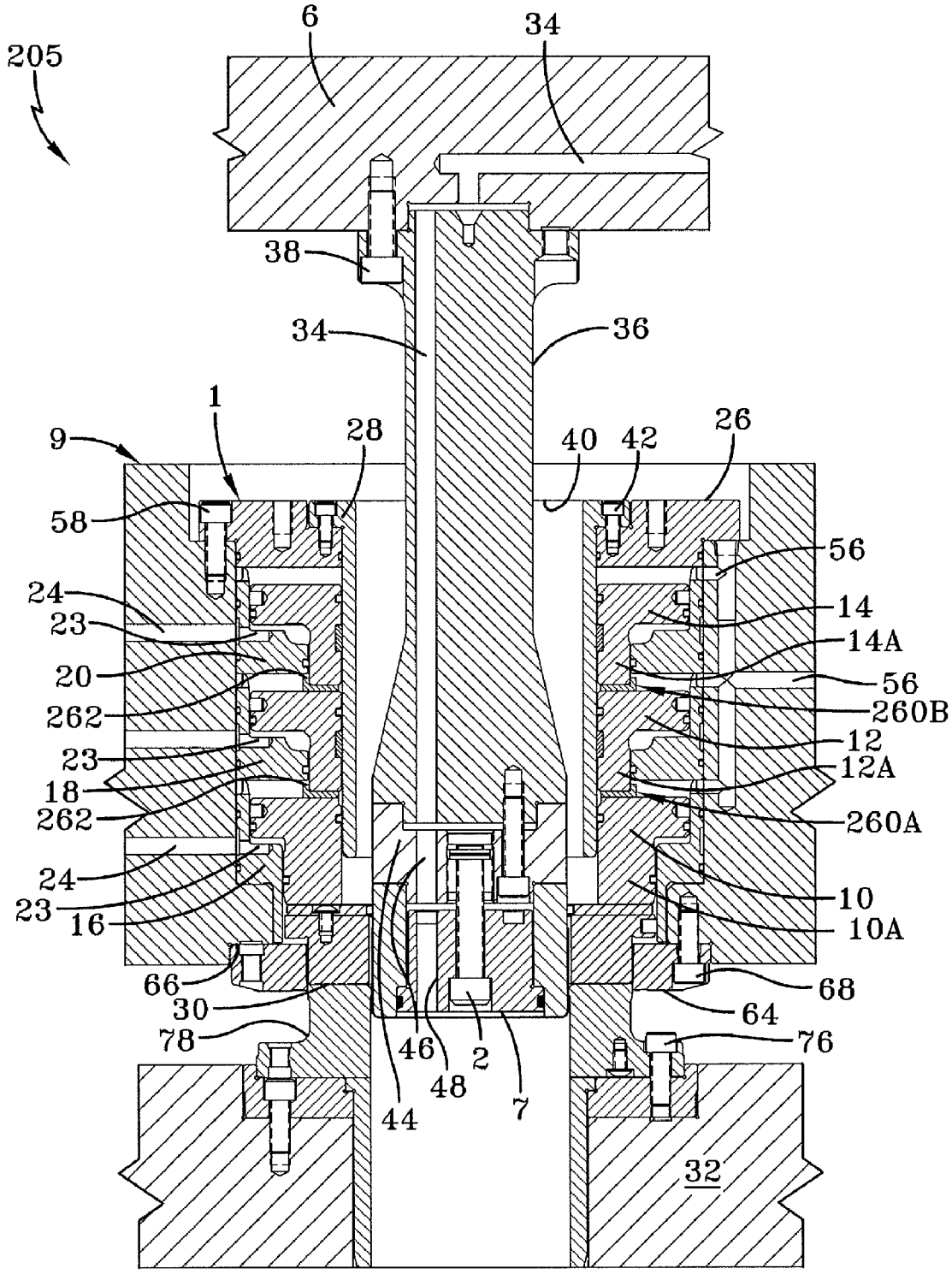
FIG. 6 is a view similar to FIG. 5, showing the outer punch assembly and the inner punch assembly of the press shortly after the beginning of the draw.

Turning now to FIGS. 5 and 6, a second preferred embodiment of the cup-shaped member forming apparatus of the present invention is shown generally at 205 and will be described in detail below in connection with a double-acting press. As second embodiment cup-shaped member forming apparatus 205 of the present invention is similar in many respects to prior art cup-shaped member forming apparatus 5 described in detail above, only the differences between the two will be described in detail below.

In accordance with one of the key features of the present invention, second preferred embodiment cup-shaped member forming apparatus 205 of the present invention includes a pair of damping members 260A,B, each of which are mounted on a respective one of pistons 10 and 12. More particularly, damping members 260A,B are generally ring-like in shape having a cross-sectional height of about 0.125 inches, a cross-sectional width of about 0.62 inches, and an overall diameter of about 6.25 inches. Damping members 260A,B are formed from urethane, or other suitable material having a bulk elasticity or stiffness of about 75A to 95A Durometer. Damping member 260A is fixedly mounted on the topmost surface of piston 10 by an adhesive, such as loctite #380. Damping member 260B is fixedly mounted on the topmost surface of Piston 12, also by a suitable adhesive, such as loctite #380. Damping members 260A,B are formed with an outer flange 262 which is about 0.25 to 0.38 inches in cross-sectional height and extends upwardly around piston leg 12A, 14A, respectively.

Having now described the structure of second preferred embodiment cup-shaped member forming apparatus 205 of the present invention, with additional reference to FIG. 6, its operation will now be described in detail below.

As outer punch assembly 9 moves downwardly toward base component 32 annular cut edge 64 contacts the metal sheet of material (not shown) which is located between draw pad 30 and blank and draw die 78 mounted on base component 32. Cut edge 64 cuts a blank from the metal sheet. The blank which has been cut by cut edge 64 is then clamped between draw pad 30 of outer punch assembly 9 and blank and draw die 78 of base component 32. More particularly, draw pad 30 exerts a continuously increasing clamping pressure onto the outer edge of the blank, capturing the outer edge of the blank between the draw pad of the outer punch assembly and blank and draw die 78 of base component 32. In this manner, the blank is held in place by the continuously increasing clamping pressure of draw pad 30 which simultaneously engages pistons 10,12,14 in order to create the continuously increasing clamping pressure. More specifically, the continuous increase in the clamping pressure is due to the existence of damping members 260A,B located between pistons 10,12, and 14. As damping members 260A,B are compressed between pistons 10,12,14, the clamping pressure exerted on blank and draw die 78 of base component 32 is continuously increased. Inner punch assembly 6 then begins to move downwardly beginning the draw stage of the press. As inner punch assembly 6 moves downwardly, draw horn 7 mounted on the inner punch assembly engages the blank of material in order to draw the blank into a cup-shaped member as outer punch assembly 9 continues to clampingly engage the outer portion of the blank. As inner punch assembly 6 nears the end of the draw stage, the outer punch assembly begins to move upwardly, continuously decreasing clamping pressure from the outer portion of the blank. As the clamping pressure is continuously decreased, the blank continues to be pushed downwardly by inner punch assembly 6 forming cup-shaped member which then drops onto conveyors (not shown) that are located in machined cavities in the underside of base component 32.

Figure 7:
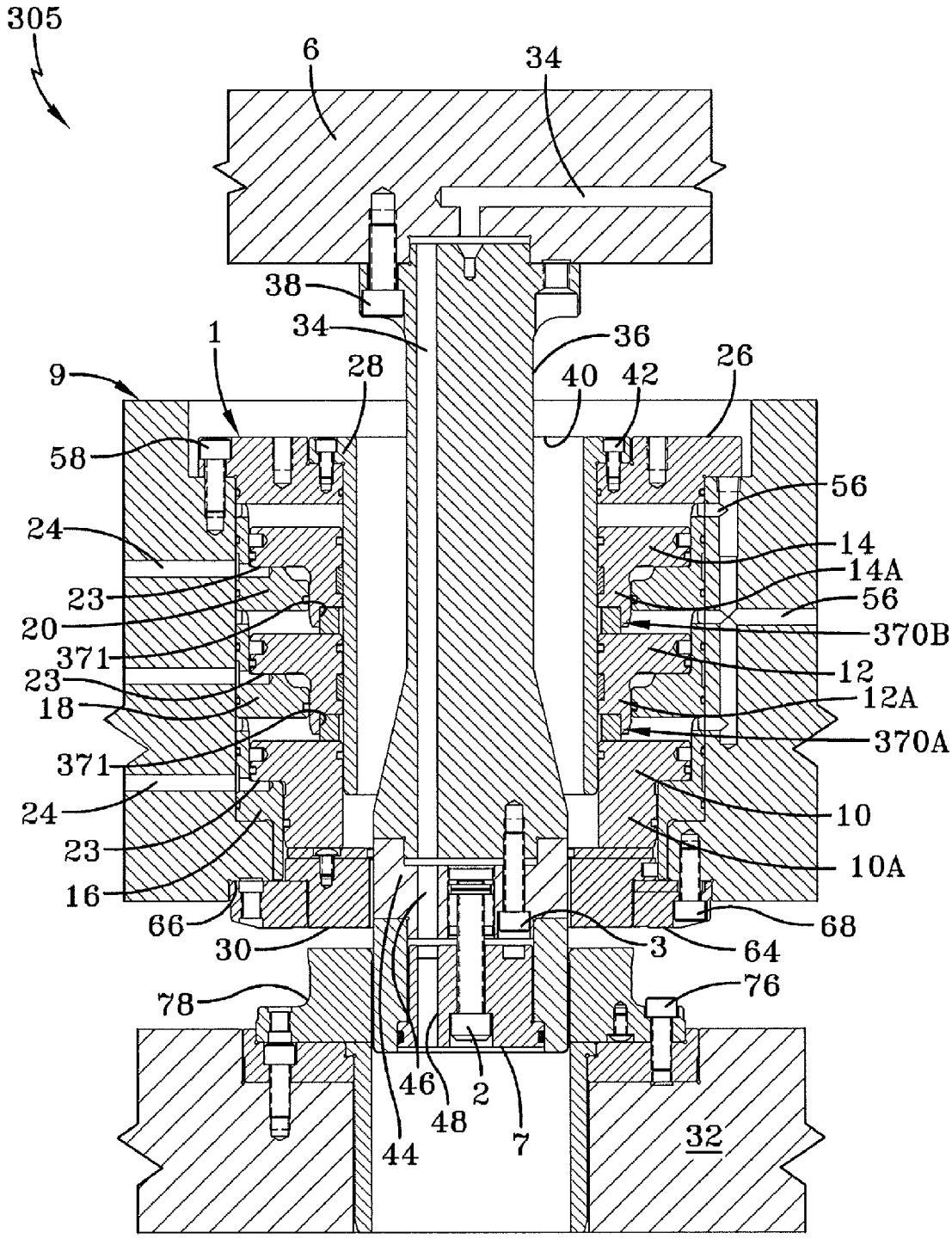
FIG. 7 is a sectional elevational view of a third preferred embodiment cup-shaped member forming apparatus of the present invention for a double-acting press, showing the damping member located between the pistons and showing the outer punch assembly and the inner punch assembly of the press at the end of the draw.
Figure 8:
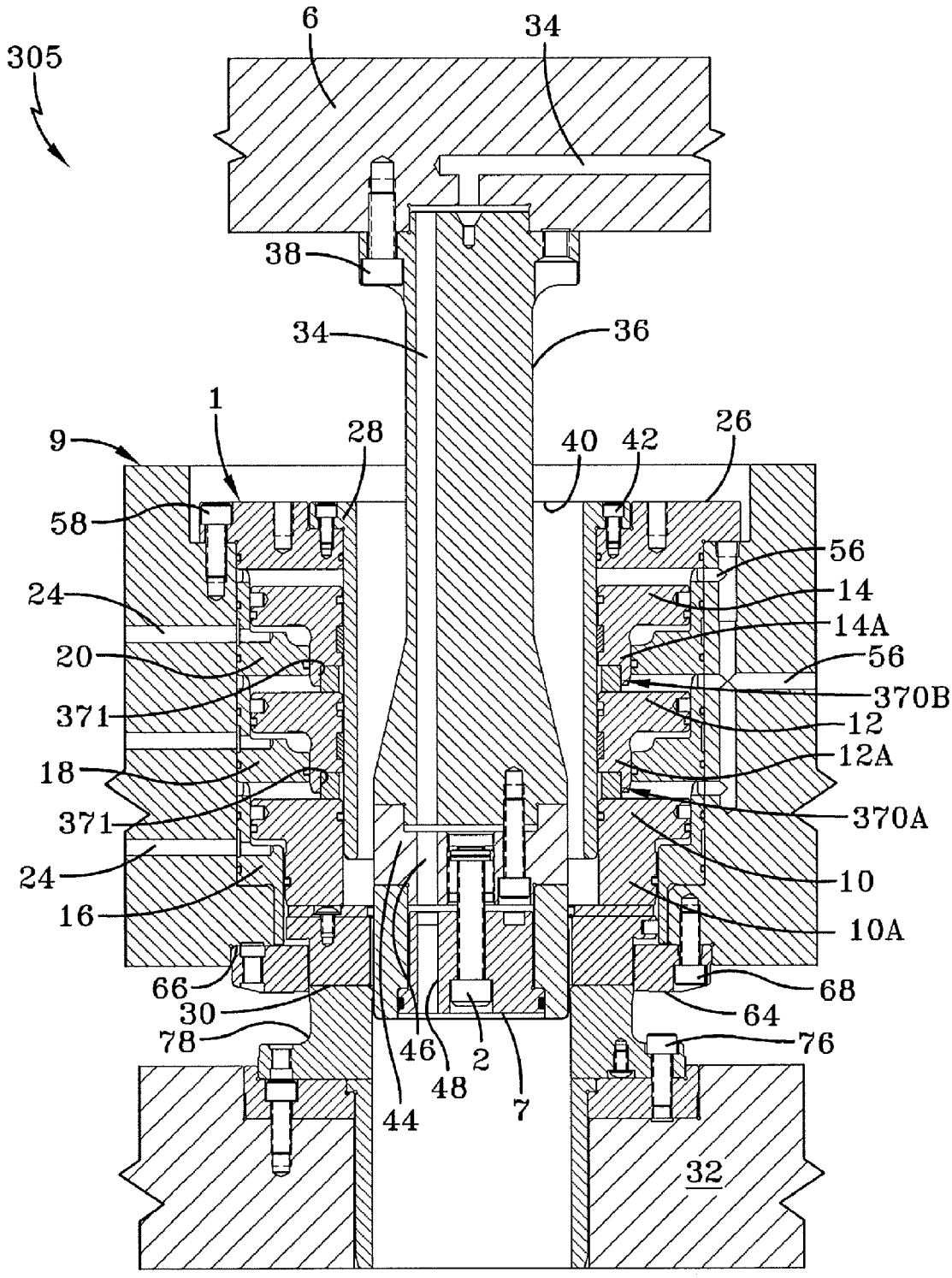
FIG. 8 is a view similar to FIG. 7, showing the outer punch assembly and the inner punch assembly shortly after the beginning of the draw.

Turning now to FIGS. 7 and 8, a third preferred embodiment of the cup-shaped member forming apparatus of the present invention is shown generally at 305 and will be described in detail below in connection with a double-acting press. As third embodiment cup-shaped member forming apparatus 305 of the present invention is similar in many respects to prior art cup-shaped member forming apparatus 5 described in detail above, only the differences between the two will be described in detail below.

In accordance with one of the key features of the present invention, third preferred embodiment cup-shaped member forming apparatus 305 of the present invention includes a pair of damping members 370A,B, each of which are mounted on a respective one of pistons 10,12. More particularly, damping members 370A,B are ring-like having a cross-sectional rectangular shape. Each of damping members 370A,B have a cross-sectional height of about 0.25 to 0.50 inches, a cross-sectional width of about 0.31 to 0.62 inches, and an overall diameter of about 5.50 to 6.00 inches. Damping members 370A,B are formed from urethane, or other suitable material having a bulk elasticity or stiffness of about 75A to 95A Durometer. A notch is formed in legs 12A and 14A of pistons 12 and 14, respectively. Damping member 370A is mounted in notch 371 of leg 12A of piston 12. Damping member 370B is mounted in notch 371 of leg 14A of piston 14. Damping members 370A,B are held in their respective notches 371 by a suitable adhesive (not shown) such as loctite #380.

Having now described the structure of first preferred embodiment cup-shaped member forming apparatus 305 of the present invention, with additional reference to FIG. 8 its operation will now be described in detail below.

As outer punch assembly 9 moves downwardly toward base component 32 annular cut edge 64 contacts the metal sheet of material (not shown) which is located between draw pad 30 and blank and draw die 78 mounted on the base component. Cut edge 64 cuts a blank from the metal sheet. The blank which has been cut by cut edge 64 is then clamped between draw pad 30 of outer punch assembly 9 and blank and draw die 78 of base component 32. More particularly, draw pad 30 exerts a continuously increasing clamping pressure onto the outer edge of the blank, capturing the outer edge of the blank between the draw pad of the outer punch assembly and blank and draw die 78 of base component 32. In this manner, the blank is held in place by the continuously increasing clamping pressure of draw pad 30 which simultaneously engages pistons 10,12,14 in order to create the continuously increasing clamping pressure. More specifically, the continuous increase in the clamping pressure is due to the existence of damping members 370A,B located between pistons 10,12, and 14. As damping members 370A,B are compressed between pistons 10,12,14, the clamping pressure exerted on blank and draw die 78 of base component 32 is continuously increased. Inner punch assembly 6 then begins to move downwardly beginning the draw stage of the press. As inner punch assembly 6 moves downwardly, draw horn 7 mounted on the inner punch assembly engages the blank of material in order to draw the blank into a cup-shaped member as outer punch assembly 9 continues to clampingly engage the outer portion of the blank. As inner punch assembly 6 nears the end of the draw stage, the outer punch assembly begins to move upwardly, continuously decreasing clamping pressure from the outer portion of the blank. As the clamping pressure is continuously decreased, the blank continues to be pushed downwardly by inner punch assembly 6 forming cup-shaped member which then drops onto conveyors (not shown) that are located in machined cavities in the underside of base component 32.

Figure 9:
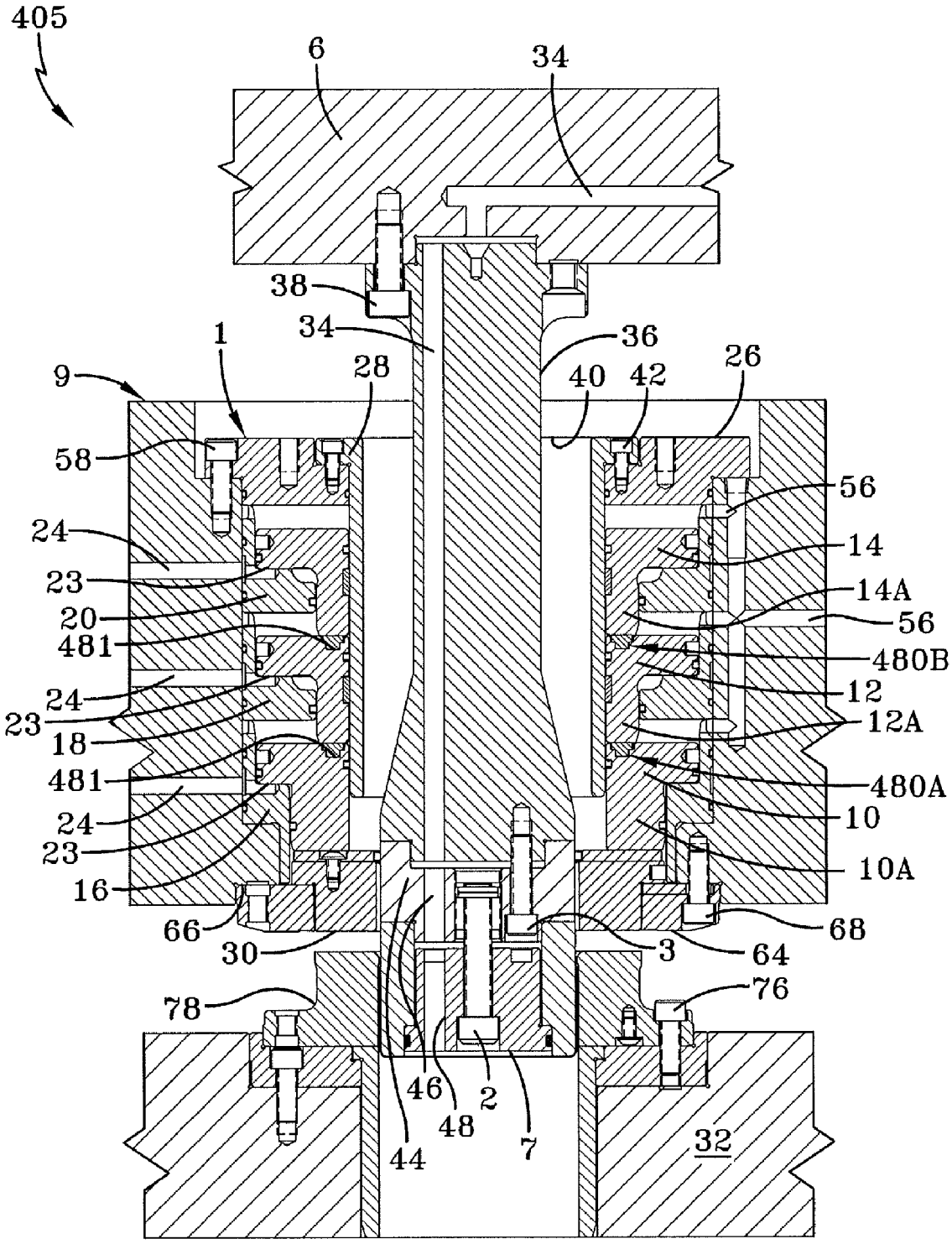
FIG. 9 is a sectional elevational view of a fourth preferred embodiment cup-shaped member forming apparatus of the present invention for a double-acting press, showing the damping member located between the pistons and showing the outer punch assembly and the inner punch assembly of the press at the end of the draw.
Figure 10:
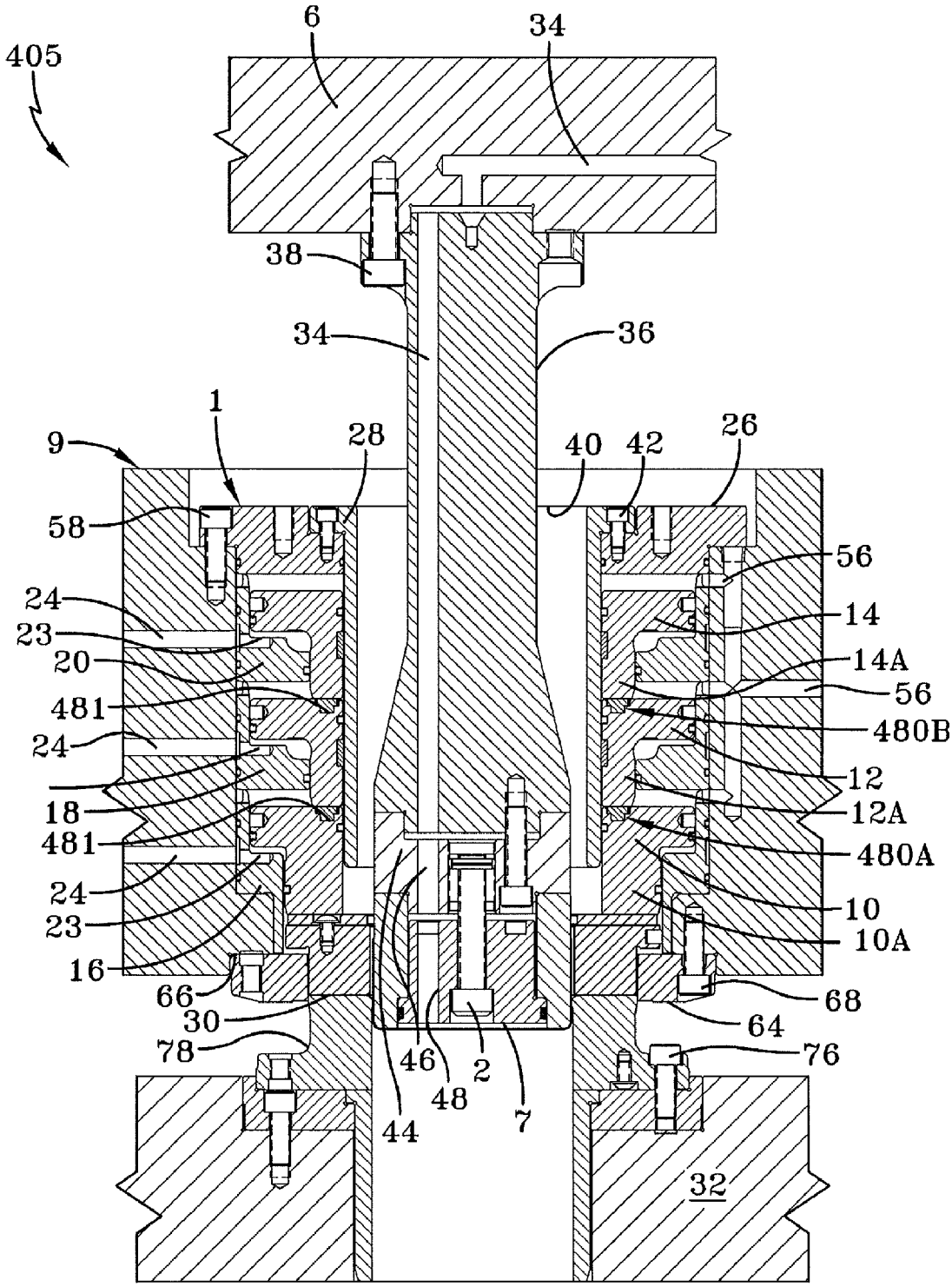
FIG. 10 is a view similar to FIG. 9, showing the outer punch assembly and the inner punch assembly shortly after the beginning of the draw.

Turning now to FIGS. 9 and 10, a fourth preferred embodiment of the cup-shaped member forming apparatus of the present invention is shown generally at 405 and will be described in detail below in connection with a double-acting press. As fourth preferred embodiment cup-shaped member forming apparatus 405 of the present invention is similar in many respects to prior art cup-shaped member forming apparatus 5 described in detail above, only the differences between the two will be described in detail below.

In accordance with one of the key features of the present invention, fourth preferred embodiment cup-shaped member forming apparatus 405 of the present invention includes a plurality of damping members 480A,B, each mounted on respective ones of pistons 10 and 12. More particularly, damping members 480A,B are button-like having a height of about 0.135 inches. Each of damping member 480A are recessed into a respective one of a plurality of circular recesses 481 which have been spaced apart and drilled into the upper surface of piston 10. Damping members 480A,B are held in their respective recesses 481 by an adhesive (not shown) such as loctite #380. Likewise, it is also contemplated that preloaded springs or other suitable damping members could be placed into recesses 481 without changing the concept of the present invention.

Having now described the structure of fourth preferred embodiment cup-shaped member forming apparatus 405 of the present invention, with additional reference to FIG. 10 its operation will now be described in detail below.

As outer punch assembly 9 moves downwardly toward base component 32 annular cut edge 64 contacts the metal sheet of material (not shown) which is located between draw pad 30 and blank and draw die 78 mounted on base component 32. Cut edge 64 cuts a blank from the metal sheet. The blank which has been cut by cut edge 64 is then clamped between draw pad 30 of outer punch assembly 9 and blank and draw die 78 of base component 32. More particularly, draw pad 30 exerts a continuously increasing clamping pressure onto the outer edge of the blank, capturing the outer edge of the blank between the draw pad of the outer punch assembly and blank and draw die 78 of base component 32. In this manner, the blank is held in place by the continuously increasing clamping pressure of draw pad 30 which simultaneously engages pistons 10,12,14 in order to create the continuously increasing clamping pressure. More specifically, the continuous increase in the clamping pressure is due to the existence of damping members 480A,B located between pistons 10,12, and 14. As damping members 480A,B are compressed between pistons 10,12,14, the clamping pressure exerted on blank and draw die 78 of base component 32 is continuously increased. Inner punch assembly 6 then begins to move downwardly beginning the draw stage of the press. As inner punch assembly 6 moves downwardly, draw horn 7 mounted on the inner punch assembly engages the blank of material in order to draw the blank into a cup-shaped member as outer punch assembly 9 continues to clampingly engage the outer portion of the blank. As inner punch assembly 6 nears the end of the draw stage, the outer punch assembly begins to move upwardly, continuously decreasing clamping pressure from the outer portion of the blank. As the clamping pressure is continuously decreased, the blank continues to be pushed downwardly by inner punch assembly 6 forming cup-shaped member which then drops onto conveyors (not shown) that are located in machined cavities in the underside of base component 32.

Figure 11:
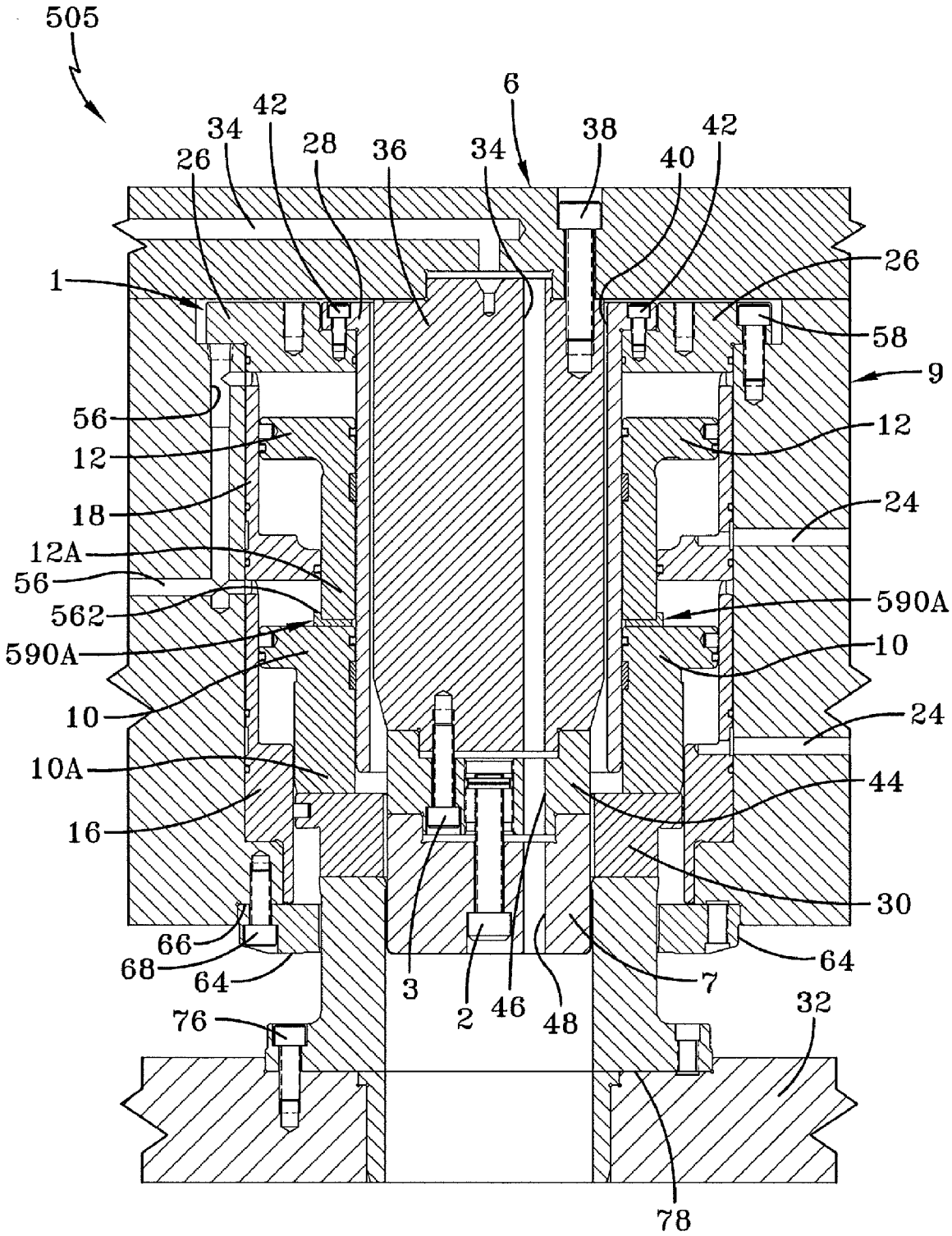
FIG. 11 is a sectional elevational view of a fifth preferred embodiment cup-shaped member forming apparatus of the present invention for a single-acting press, showing the damping member located between the pistons and showing the outer punch assembly and the inner punch assembly of the press during the draw.
Figure 12:
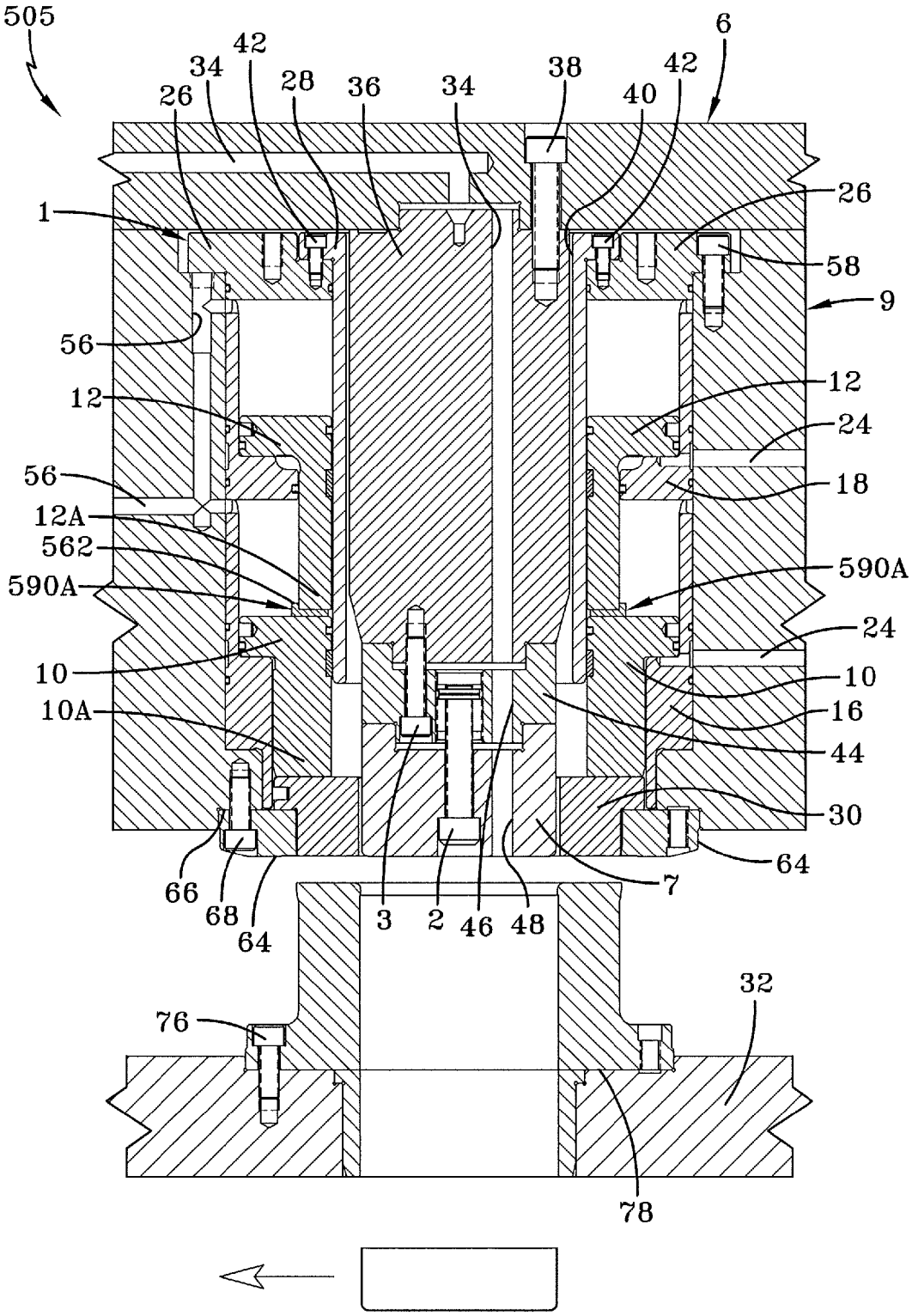
FIG. 12 is a view similar to FIG. 11, showing the outer punch assembly and the inner punch assembly after the draw has completed.

Turning now to FIGS. 11 and 12, a fifth preferred embodiment of the cup-shaped member forming apparatus of the present invention is shown generally at 505 and will be described in detail below in connection with a single-acting press. Fifth preferred embodiment cup-shaped member forming apparatus 505 of the present invention is similar in many respects to second embodiment cup-shaped member forming apparatus 205 described in detail above with the only difference being that cup-shaped forming apparatus 505 is described in connection with a single-acting press.

Cup-shaped member forming apparatus 505 includes an outer punch assembly 9 and an inner punch assembly 6. A base component 32 is located generally below inner and outer punch assemblies 6 and 9. Base component 32 is fixed with respect to inner punch assembly 6 and outer punch assembly 9 so that the inner punch assembly and the outer punch assembly move toward the base component. When utilized in conjunction with a single-acting press as shown in FIGS. 11 and 12, outer punch assembly 9 and inner punch assembly 6 are mounted on the single ram (not shown) of the press in a manner well known in the art.

A riser 36 is mounted on inner die assembly 6 via a plurality of bolts 38 (only one shown), or other suitable fasteners. Riser 36 and inner die assembly 6 are formed with an air passage 34 which is in fluid communication with a pneumatic air supply (not shown) such that compressed air is directed through the air passage during operation of the press. Riser 36 extends from the bottom of inner punch assembly 6 through an opening 40 formed in outer punch assembly 9 formed by a draw sleeve 28 which is in turn attached to an end cap 26 via a plurality of bolts 42 (only two shown), or other suitable fasteners. A spacer 44 is attached to the lower end of riser 36 via a plurality of bolts 3 (only one shown), or other suitable fasteners, Spacer 44 is formed with an air passage 46 which is in fluid communication with air passage 34 of riser 36. A draw horn 7 is, in turn, mounted on the bottom of spacer 44 via a bolt 2, or other suitable fastener. Draw horn 7 is formed with an air passage 48 which is in fluid communication with air passage 34 of riser 36 via air passage 46 of spacer 44. Air passages 48,34,46 allow compressed air from the pneumatic air supply (not shown) to pass through riser 36, through spacer 44, and through draw horn 7 in order to force the cup-shaped member from the draw horn at the end of the drawing process.

Both outer punch assembly 9 and inner punch assembly 6 are mounted on the single ram (not shown) of the single-acting press in a manner well known to those having skill in the art.

Outer punch assembly 9 includes a pressure piston system 1 which consists of first and second pistons 10 and 12, respectively, stacked on top of one another and each of which are in fluid communication with a source of high pressure air via conduits 56. Pistons 10 and 12 are carried within cylinders 16 and 18, respectively. Each cylinder 16 and 18 is formed with an air passage 24 which is in fluid communication with atmosphere. End cap 26 seals the top of pressure piston system 1 and is attached via a plurality of bolts 58 (only one shown), or other suitable fasteners. Sleeve 28 forms a portion of pressure piston system 1. More particularly, sleeve 28 forms an inner portion of the chamber within which pistons 10 and 12 operate.

In accordance with one of the key features of the present invention, fifth preferred embodiment cup-shaped member forming apparatus 505 of the present invention includes a damping member 590A which is mounted on piston 10. More particularly, damping member 590A is generally ring-like in shape having a cross-sectional height of about 0.125 inches, a cross-sectional width of about 0.62 inches, and an overall diameter of about 6.25 inches. Damping member 590A is formed from urethane, or other suitable material having a bulk elasticity or stiffness of about 75A to 95A Durometer. Damping member 590A is fixedly mounted on the topmost surface of piston 10 by an adhesive, such as loctite #380. Damping member 590A is formed with an outer flange 562 which is about 0.25 to 0.38 inches in cross-sectional height and extend upwardly around piston leg 12A.

An annular draw pad 30 is operatively mounted in a stacked relationship beneath piston 10 in a manner well known in the art. Annular draw pad 30 operatively engages the lower leg 10A of piston 10. An annular cut edge 64 is mounted via a plurality of bolts 68 (only one shown) within a recess 66 in outer die assembly 9 around draw pad 30 and slidably engages draw pad 30. Base component 32 carries an annular blank and draw die 78 which is secured to the base by a plurality of bolts 76 (only one shown), or other suitable means of attachment.

As set forth above, draw pad 30 is engaged with lower leg 10A of piston 10. Piston 10 is in turn engaged with a lower leg 12A of piston 12. Draw pad 30 clampingly engages blank and draw die 78 of base component 32 in order to clamp a blank of material (not shown) to the die so that the blank can be drawn by draw horn 7 of inner punch assembly 6 during operation of the press.

Having described the structure of cup-shaped member forming apparatus 505 used in conjunction with a single-acting press, the operation of the cup-shaped member forming apparatus in a single-acting press will now be described. FIG. 11 shows cup-shaped member forming apparatus 505 following the blanking stage and shortly after beginning of the drawing stage of the operation. As outer punch assembly 9 moves downwardly toward base 32 annular cut edge 64 contacts the metal sheet of material (not shown) which is located between draw pad 30 and blank and draw die 78 of base 32. As outer punch assembly 9 continues downwardly, cut edge 64 cuts a blank from the metal sheet. The blank which has been cut by cut edge 64 is then clampingly engaged between draw pad 30 of outer punch assembly 9 and blank and draw die 78 of base component 32. More particularly, draw pad 30 exerts a continuously increasing clamping pressure on the outer edge of the blank and blank and draw die 78 below, capturing the outer portion of the blank between the draw pad of the outer punch assembly and the blank and draw die. In this manner, the blank is held in place by the continuously increasing clamping pressure of draw pad 30 which simultaneously engages pistons 10 and 12 and damping member in order to create the continuously increasing clamping pressure. Inner punch assembly 6 also moves downwardly starting the draw stage of the operation. As inner punch assembly 6 moves downwardly, draw horn 7 mounted on the inner punch assembly engages the blank of material in order to draw the blank into a cup-shaped member as outer punch assembly 9 continues to clampingly engage the outer portion of the blank. Once inner punch assembly 6 has drawn the blank, both the inner punch assembly and outer punch assembly 9 begin to move upwardly continuously decreasing the clamping pressure from the out portion of the blank. The cup-shaped member is forced off of draw horn 7 by the compressed air passing through air passage 48. The cup-shaped member then drops onto conveyors (not shown) that are located in machined cavities in the underside of base component 32.

All five of the above-described embodiments of the present invention solve many problems encountered in prior art cup-shaped member forming apparatus 5. As previously discussed, prior art cup-shaped member forming apparatus 5 includes pistons 10,12,14 which simultaneously engage one another and draw pad 30 in order to clampingly engage the blank material (not shown) to blank and draw die 78 of base 32. This simultaneous engagement results in an instantaneous clamping force of about 6,000 pounds. These instantaneous large clamping forces can potentially cause pistons 10,12,14 of outer ram 9 to wear or fail prematurely. In addition, these large instantaneous clamping forces can potentially cause excessive noise and vibration in the press itself, which can in turn potentially lead to premature failure of the press or the press components.

The first, second, third, fourth, and fifth embodiments of the present invention solve these problems by providing damping members 150A,B, 260A,B, 370A,B, 480A,B, 590A between and/or on pistons 10,12 and 14 which allow for simultaneous engagement of the pistons with draw pad 30 in order to reduce initial instantaneous clamping pressures on blank and draw die 78 of base 32 by providing a continuous increase in clamping pressures to reduce noise and vibration as well as limiting wear between the pistons of pressure piston system 1 which in turn increases the wear life of the pistons as well as the components of the press itself.

It is understood that although damping members 150A,B, 260A,B, 370A,B, 480A,B, 590A have been described with particular shapes, other cross-sectional shapes of the damping members on or between pistons 10,12,14 are also contemplated by the present invention. For example, cross-sectional shapes such as polygonal, ovoid or circular could be utilized without affecting the overall concept of the present invention. It should also be understood that damping members 150A,B, 260A,B, 370A,B, 480A,B, 590A have been described with particular locations and arrangements, however, other locations and arrangements could be utilized without changing the overall concept of the present invention. For example, the damping member could be incorporated into a portion of one or more of the pistons such that the damping members are internal to one or more of the pistons, such as replacing a portion of one or more of the legs of the pistons with a damping member material. It is also contemplated that damping members can be used between less than all of the pistons such as only between two of the three pistons, also without affecting the overall concept of the present invention. It is even further contemplated that more than one damping member could be utilized in connection with each pistons such as two or more, also without changing the overall concept of the present invention. It is yet even further contemplated that different types of materials and damping means, such as springs, could also be utilized without affecting the overall concept of the invention. It is also contemplated that each of the cup-forming apparatuses described above could be utilized with either a single-acting or a double-acting press without altering the overall concept of the invention.

Accordingly, the improved cup-shaped member forming apparatus of the present invention is simplified, provides an effective, safe, inexpensive, and efficient means for forming cup-shaped members which achieves all the enumerated objectives, provides for eliminating difficulties encountered with prior art cup-shaped member forming apparatuses, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved cup-shaped member forming apparatus is constructed, arranged and used, the characteristics of the construction and arrangement, and the advantageous, new and useful results obtained; the new and useful structures, devices, elements, arrangements, parts and combinations, and methods are set forth in the appended claims.

What is claimed is:

1. A cup-shaped member forming apparatus for use in a single acting press or a double-acting press having an outer punch assembly, an inner punch assembly and a base, comprising:

a) a draw pad and a cutting edge carried on said outer punch assembly; a draw horn carried on said inner punch assembly; a blank and draw die carried on said base, said blank and draw die generally opposing said draw pad and said draw horn, said cutting edge configured to engage a sheet material disposed between said draw pad and said blank and draw die for cutting a disk from said sheet material, said draw pad configured to engage said disk and said blank and draw die for exerting a clamping force on said disk and said blank and draw die during operation of said press; and b) a pressure piston system carried by said outer punch assembly, said pressure piston system being operatively connected to a pneumatic air supply and including at least a first piston and a second piston, said first and second pistons being vertically stacked with respect to one another, said first piston being operatively mounted on a first cylinder and said second piston being operatively mounted on a second cylinder, said pressure piston system further including a damping member, said first piston operatively engaged with said draw pad such that when said outer punch assembly is advanced toward said base said clamping force of said draw pad on said disk and said blank and draw die is continuously increased.

2. The apparatus of claim 1, said damping member being disposed between said first piston and said second piston.

3. The apparatus of claim 1, said damping member having a stiffness rating of between about 55 A and 95 A Durometer.

4. The apparatus of claim 1, said damping member is formed from urethane.

5. The apparatus of claim 1, whereby said damping member being compressed about 0.010 to about 0.015 inches is capable of directing a force on said second piston equivalent to or greater than a force of the second piston on the damping member during operation of said press.

6. The apparatus of claim 1, said pressure piston system further comprising a third piston, said third piston mounted on a third cylinder and disposed in a stacked relationship above said second piston, said second and third pistons having a second damping member disposed therebetween for continuously increasing said clamping force during operation of the press.

7. The apparatus of claim 1, wherein said damping member further comprises a plurality of button-shaped inserts spaced apart and imbedded into a top surface of said first piston.

8. The apparatus of claim 1, wherein said damping member is ring-shaped and imbedded within a top surface of said first piston.

9. The apparatus of claim 1, wherein said damping member is ring-shaped and disposed on a top surface of said first piston.

10. The apparatus of claim 1, said damping member having a stiffness rating of between about 55 A and 95 A Durometer.

11. A method of forming a cup-shaped member from a metal sheet in a single-acting or a double-acting press having an inner punch assembly, an outer punch assembly, and a base, comprising the steps of:

a) providing a draw pad and a cut edge carried on said outer punch assembly;

b) providing a draw horn carried on said inner punch assembly;

c) placing a sheet material between a blank and draw die mounted on said base of said press and said draw pad, said cut edge, and said draw horn;

d) advancing said cut edge and said draw pad toward said sheet material and said blank and draw die by moving said outer punch assembly toward said base;

e) blanking a disk from said metal sheet by advancing said cut edge;

f) providing a pressure piston system including a first and a second piston, said first piston engaged with said second piston and with said draw pad, said pressure piston system further including a damping member, said pistons operatively connected to a pneumatic air supply;

g) applying a continuously increasing clamping pressure on said metal sheet by advancing said outer punch assembly and the pistons toward said base; and h) drawing the cup-shaped member from said disk by advancing said draw horn toward said base.

12. The method of claim 11, wherein said damping member is disposed between said first piston and said second piston.

13. The method of claim 11, wherein a pneumatic pressure applied to each piston is about 2,000 pounds.

14. The method of claim 11, wherein said damping member is formed from urethane.

15. The method of claim 11, wherein said damping member has a cross-sectional height of about 0.125 to 0.50 inches.

16. The method of claim 11, whereby said damping member being compressed about 0.010 to about 0.015 inches is capable of directing a force on said second piston equivalent to or greater than a force of the second piston on the damping member during operation of said press.

17. The method of claim 11, wherein a third piston is disposed above and in a stacked relationship with said first and second pistons, said third piston connected to said pneumatic air supply, a second damping member being disposed between said third piston and said second piston.

* * * * *